United States Patent [19]

Gedicks

[11] 4,299,409

[45] Nov. 10, 1981

[54] SKI POLE

[76] Inventor: Klaus Gedicks, 2209 W. 46th Ave., Anchorage, Ak. 99503

[21] Appl. No.: 966,579

[22] Filed: Dec. 5, 1978

[51] Int. Cl.[3] ..... A63C 11/22

[52] U.S. Cl. ..... 280/819; 280/824; 297/423; 135/66

[58] Field of Search ..... 280/11.37 B, 11.37 E, 280/11.37 Z, 11.37 N; 248/293; 297/423, 438, 184; 135/65, 66, 16

[56] References Cited

U.S. PATENT DOCUMENTS

| | | | |
|---|---|---|---|
| 250,328 | 11/1881 | Hughes | 135/65 |
| 2,709,603 | 5/1955 | Osmun | 280/812 |
| 3,001,483 | 9/1961 | Gmeiner . | |
| 3,179,436 | 4/1965 | Choy | 135/66 |

FOREIGN PATENT DOCUMENTS

| | | | |
|---|---|---|---|
| 2026732 | 12/1971 | Fed. Rep. of Germany B | 280/11.37 |
| 503168 | 7/1930 | Fed. Rep. of Germany | 135/66 |
| 434986 | 10/1967 | Switzerland | 280/11.37 E |

*Primary Examiner*—H. Grant Skaggs
*Attorney, Agent, or Firm*—Burns, Doane, Swecker & Mathis

[57] ABSTRACT

A ski pole according to the present invention is improved so as to provide a foot support when a skier is traveling on a ski chair lift and the like. The ski pole itself is conventional and includes an elongated shaft provided with a handle. A basket is conventionally provided at a lower end of the ski pole and is typically made of a flexible material. The ski pole tapers to a point at the lower end of the pole. The improved ski pole includes a first bracket which is preferably pivotally mounted at approximately a mid-section of the shaft. The first bracket is preferably channel shaped and movable between a first position which is perpendicular to the shaft and a second position which is aligned with the shaft. In the aligned position, the first bracket releasably grips the shaft of the ski pole. The first bracket is selectively fixable relative to the shaft so as to provide a fixed obstruction to movement of the pole relative to an edge of a chair of a ski lift. A second bracket which preferably includes an annular disk is provided on the shaft at a predetermined distance beneath the first bracket. In a preferred embodiment, the annular disk is fixed immediately above the basket with a cotter pin extending through the shaft immediately beneath the basket. In this way, the annular disk provides a foot rest for the skier. In use, the first bracket is hooked onto the edge of the chair of a ski lift so that the lowermost portion of the ski pole extends downwardly between the legs of the skier. The skier may then place his skis on the annular disk so that the feet may be comfortably supported during travel on the chair lift.

12 Claims, 8 Drawing Figures

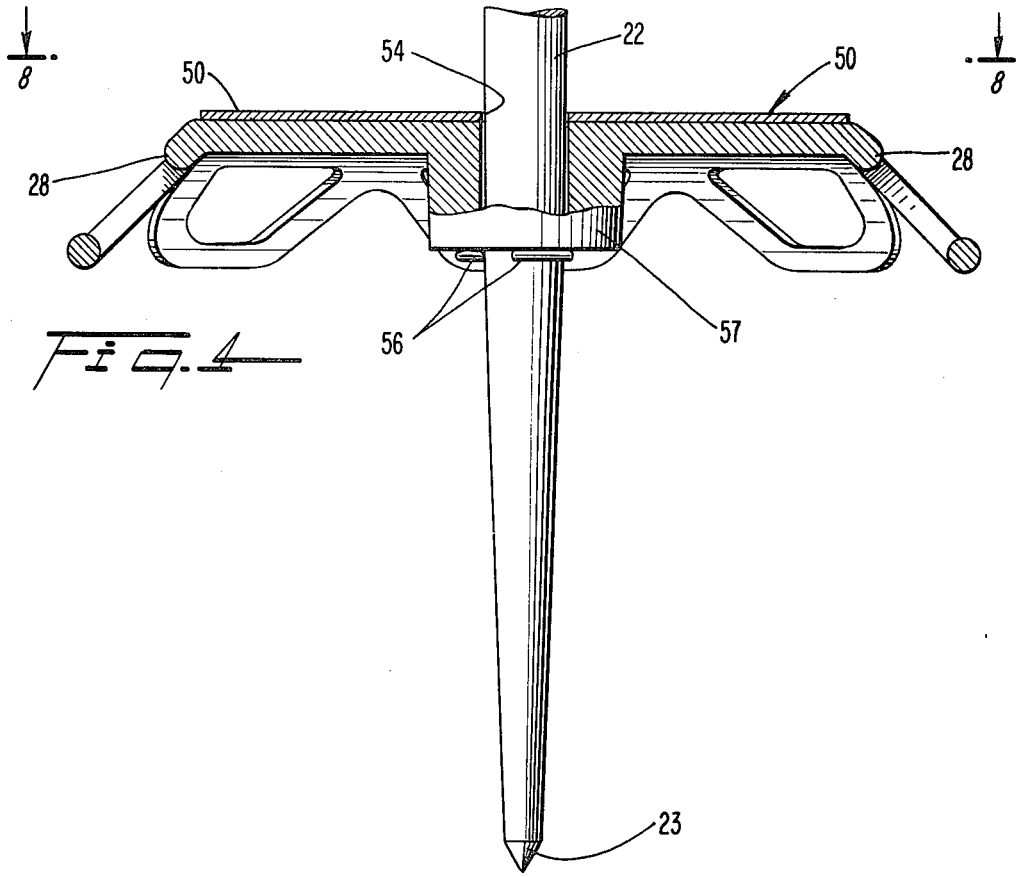
Fig. 4
Fig. 8
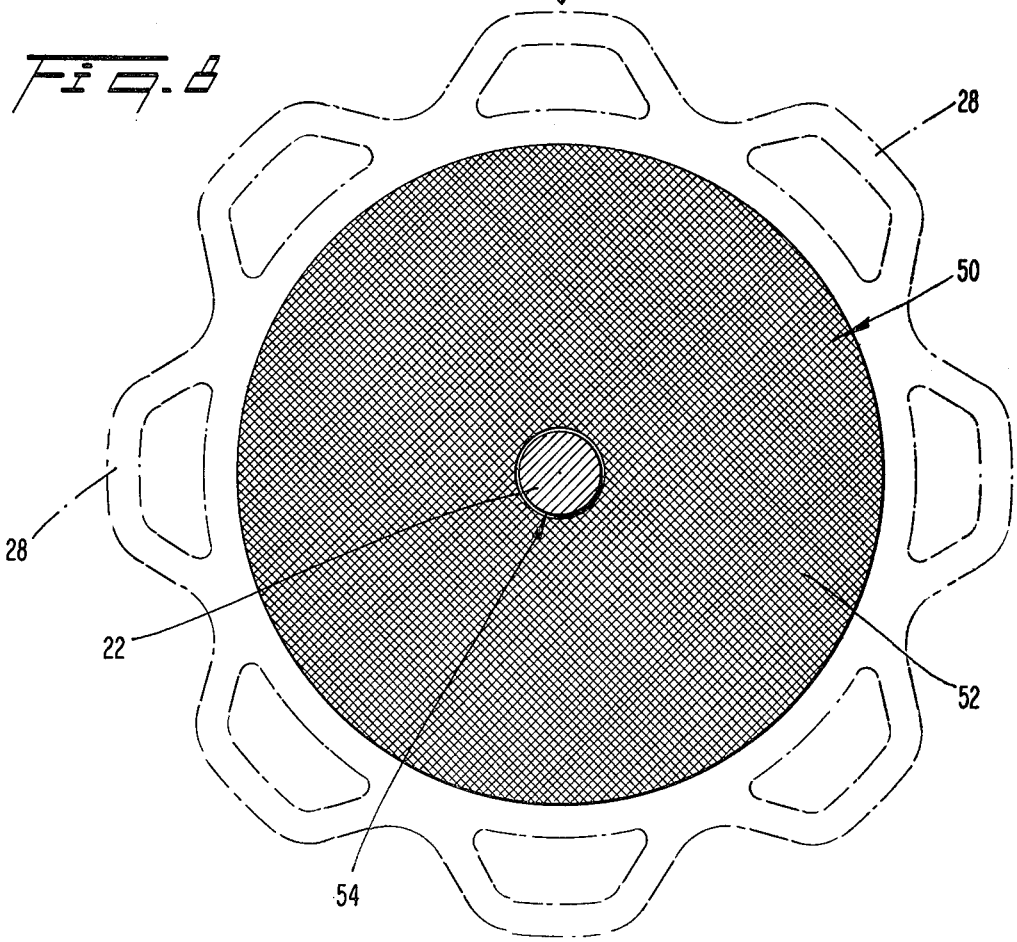

SKI POLE

BACKGROUND AND SUMMARY OF PREFERRED FORMS OF THE PRESENT INVENTION

The present invention relates generally to ski poles and more specifically relates to attachments for ski poles.

Skiing is a sport which involves a substantial amount of physical activity. Accordingly, it is not uncommon for skiers to become physically exhausted during a prolonged period of skiing. During downhill skiing sessions, the skier often travels to the top of the hill on a ski lift between periods of downhill skiing. It would be desirable to make the skier as comfortable as possible while being transported to the top of the hill on the ski lift so as to take maximum advantage of the rest periods provided during travel on the ski lift.

Many chair type ski lifts, however, do not include foot rests. While traveling on such ski lifts, the skier's feet are free to dangle from the seat of the ski lift. Furthermore, the skier is wearing rather heavy ski boots and skis which together exert a considerable downward pull on the skier's feet and legs. Prolonged travel on a ski chair lift may actually contribute to the physical exhaustion of a skier as a result of the downward pull of the boots and skis.

Of the various ski pole attachments known in the prior art (see e.g., U.S. Pat. Nos. 3,179,436 and 3,350,111 which respectively disclose a ski pole seat and a boot scraper), none are known to provide a foot rest for use on a chair ski lift.

Accordingly, it is an object of the present invention to provide an improved ski pole which permits the skier to rest his feet while traveling on a ski chair lift.

Another object of the present invention is to provide an improved ski pole that serves as a foot rest and which does not interfere with the use of the ski pole during skiing.

Still another object of the present invention is to provide an improved ski pole which may be hooked onto the chair of a ski lift so as to provide a rigid support for both feet of the skier.

Yet still another object of the present invention is to provide an apparatus for improving a ski pole so as to provide a ski pole which provides a foot rest when a skier is traveling on a chair ski lift.

These and other objects of the present invention will become obvious from the following detailed description of the present invention and from the accompanying drawings of a preferred embodiment of the present invention.

The improved ski pole and apparatus for improving a ski pole according to the present invention relate to a conventional ski pole having a handle at an upper end and a basket at a lower end of the ski pole. A first bracket member is pivotably mounted on a shaft of the ski pole preferably at a mid-section of the shaft. The first bracket member preferably is channel shaped having first and second side portions and a web portion extending between the two side portions. The side portions extend beyond the web portion with the bracket member pivotable about an axis extending through the extensions of the side portions and perpendicularly through an axis of the shaft. The first bracket member is pivotable between a first position and a second position with the bracket member extending perpendicularly with respect to the ski pole in the first position. The end of the web portion limits the pivoting movement of the first bracket member to a predetermined position. Further movement of the first bracket member towards the handle of the ski pole is thereby prevented. In the second position, the first bracket member is substantially aligned with the shaft. The side portions of the bracket member releasably grip the shaft so as to releasably fix the bracket member on the shaft. In this way, the bracket member will remain stationary with respect to the ski pole during skiing.

A second bracket member which preferably includes an annular disk is provided on the shaft at a predetermined distance beneath the first bracket member. Preferably, the annular disk is located immediately above the basket of the ski pole. The annular disk is provided with a concentric bore or passageway to accept the shaft of the ski pole. Axial movement of the annular disk toward the lower end of the ski pole is obstructed, for example, by a cotter pin which passes through a bore of the ski pole. In this way, the first and second bracket members may be provided at a predetermined axial distance with respect to one another during use.

When used as a foot rest, the first bracket member is fixed outwardly with respect to the ski pole and is hooked onto a front edge portion of a chair of a ski lift. The ski pole is oriented generally vertically with the lower portion of the ski pole extending downwardly between the legs of the skier. Preferably, the distance between the first and second bracket members corresponds approximately with the distance between the knee and the foot of the skier. In this way, the skier may comfortably position his skis on the annular disk (or second bracket member) to thereby rest his feet.

BRIEF DESCRIPTON OF THE DRAWINGS

Other objects and advantages of the present invention will become apparent in the subsequent description of a preferred embodiment thereof with reference to the accompanying drawings, wherein like members bear like reference numerals and wherein:

FIG. 4 is an enlarged view in partial cross section of the lower end of the improved ski pole of FIG. 1;

FIG. 8 is a view through the line 8—8 of FIG. 4.

DETAILED DESCRIPTION OF A PREFERRED EMBODIMENT

Figure 1:
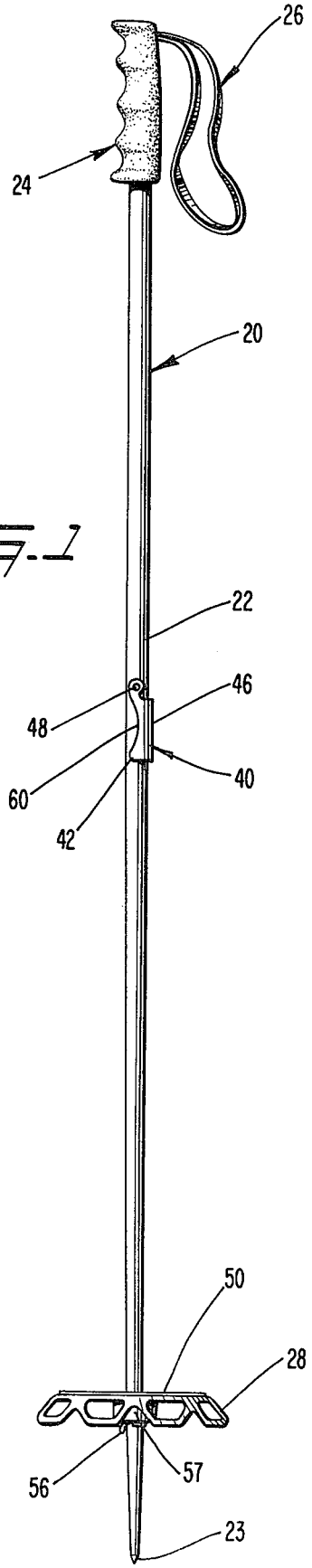
FIG. 1 is a side view of an improved ski pole according to the present invention.

A preferred embodiment of the present invention, with reference to FIG. 1, includes an improved ski pole which is generally indicated at 20. The improved ski pole includes an elongated shaft 22 which is provided with a handle 24 at an upper end of the shaft. The ski pole shaft 22 may be of various materials and is preferably of metal. The ski pole handle is typically of leather or plastic and oftentimes includes a strap 26. A basket 28 is provided at a lower end of the ski pole shaft 22. The basket may be entirely of plastic or may include a metal hoop (not illustrated) which is attached to the shaft 22 by a plurality of flexible members (not illustrated). The flexible members are typically of leather or plastic. The elements of a conventional ski pole including the shaft, handle, strap and basket are all well known in the art of skiing.

The ski pole shaft 22 is generally cylindrical throughout the extent of the shaft. The lowermost end of the shaft tapers toward the tip of the shaft and ends at a rounded point 23. The shaft may be of one piece construction or may be an assembly of two or more pieces.

Figure 5:
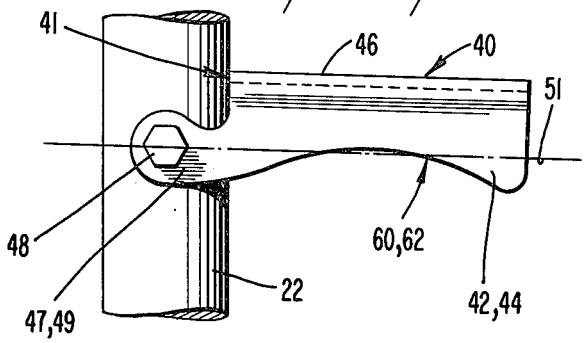
FIG. 5 is a side view of the mid-section of the improved ski pole of FIG. 1 illustrating the first bracket member in the extended position.
Figure 6:
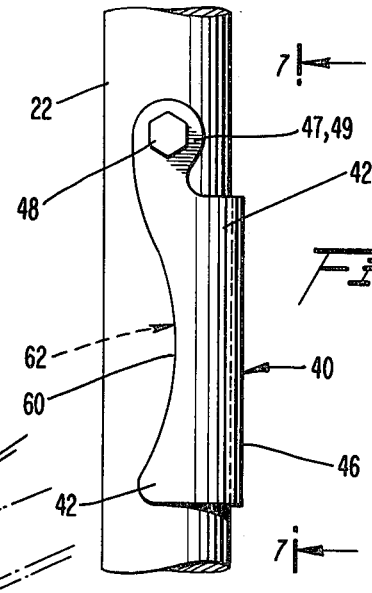
FIG. 6 is a side view of the mid-section of the improved ski pole of FIG. 1 illustrating the first bracket member in the aligned position.
Figure 7:
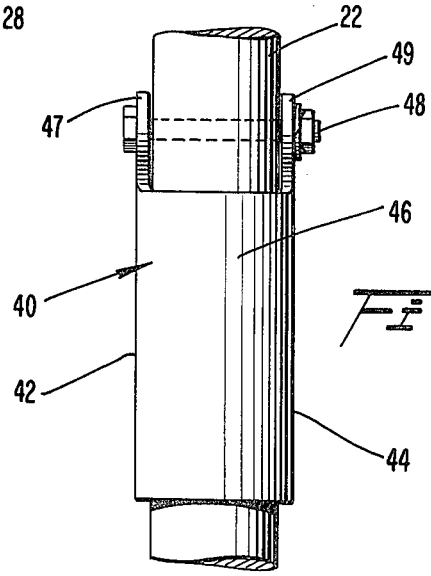
FIG. 7 is a view through the line 7—7 of FIG. 6.

A first bracket 40 is pivotably attached to the shaft 22 at approximately a mid-section of the shaft. With reference to FIGS. 5–7, the bracket 40 is channel shaped and includes first and second side portions 42, 44 which are joined together by a web portion 46 through less than the entire length of the side portions. The side portions extend beyond the web portion so as to provide first and second flange portions 47, 49. The first bracket member is pivotably mounted on the shaft 22 by a pivot member 48 which passes through the flange portions and through the shaft perpendicularly to an axis of the shaft.

The bracket 40 is movable between a first position (see (FIG. 5) with the bracket extending generally perpendicularly with respect to the ski pole and a second position (see FIG. 6) with the bracket substantially aligned with the pole. The web portion 46 is arranged so as to oppose movement of the bracket 40 towards the handle 24 beyond a predetermined orientation. As the bracket 40 is pivoted upwardly about the member 48, an edge of the web 46 comes into contact with the shaft of the ski pole as indicated at 41. The bracket 40 is free to pivot downwardly towards the basket 28 until the bracket 40 is substantially aligned with the shaft 22. In the aligned configuration, the web 46 again contacts the surface of the shaft to prevent further movement of the bracket 40 in the same direction. To accomplish the functions of limiting maximum movement of the bracket 40, the web portion 46 is preferably offset and parallel with respect to a line through a radius of the member 48. Such a line 51 is illustrated in FIG. 5. Accordingly, the bracket 40 provides a hook like member which may oppose movement of the ski pole relative to a rigid object such as a chair of a ski lift.

The side portions 42, 44 of the bracket 40 are spaced away from one another a distance which is slightly less than the diameter of the shaft 22. In this way, the side portions frictionally engage the shaft 22 when the bracket is in the substantially aligned position. The bracket 40 releasably grips the shaft while the ski pole is used during skiing but is free to be pivoted upwardly to the first position when the skier is about to travel on a ski lift.

The first bracket member 40 is preferably provided with a recess indicated at 60, 62 on each of the side portions 42, 44. These recesses serve as "notches" to permit the first bracket member to hook on an edge or a cylindrical member of the chair lift such as a tube or pipe.

A second bracket member 50 (with reference to FIGS. 4 and 8) preferably includes an annular disk 52 which is concentrically mounted on the shaft 22. The annular disk 52 includes a centrally located passageway 54 which has a diameter corresponding to the diameter of the section of the ski pole at the location of the member 52. The annular member 52 is preferably positioned immediately above the basket 28 so that the annular member will be in a particularly unobstructive location. The disk 52 is preferably knurled as indicated in FIG. 8. In this way, the disk 52 provides a non-slip surface for receiving the skis of the skier.

A cotter pin 56 is provided in a bore 58 of the shaft 22. The cotter pin 56 is located immediately beneath a collar 57 (see especially FIG. 4) of the basket so as to limit the downward movement of the basket and the disk to a predetermined maximum position away from the bracket member 40. The collar 57 typically securely engages the shaft 22 to mount the basket 28 on the ski pole. The cotter pin 56 may be located as desired either above or below the basket 28 depending upon the particular characteristics of the basket.

Preferably, the annular disk 50 has a diameter which is slightly less than the diameter of the basket 28. In this way the annular disk does not extend obtrusively beyond the basket. If the annular disk were to extend substantially beyond the perimeter of the basket 28, the disk may possibly contact the legs of the skier during skiing which is generally undesirable. Since the disk 52 is located above the basket 28, the annular disk does not interfere with the function of the basket during skiing.

Preferably, the second bracket member is symmetrical about a central axis and has a smooth perimeter once again for the purpose of not interfering with the use of the ski pole during skiing. It is only necessary, however, that the second bracket member extend in opposite directions on either side of the ski pole so as to provide a support for the skis and boots of the skier. If the second bracket member only included two or more spoke like projections, however, the projections could possible provide a dangerous threat to the skier in the event of a fall.

Figure 2:
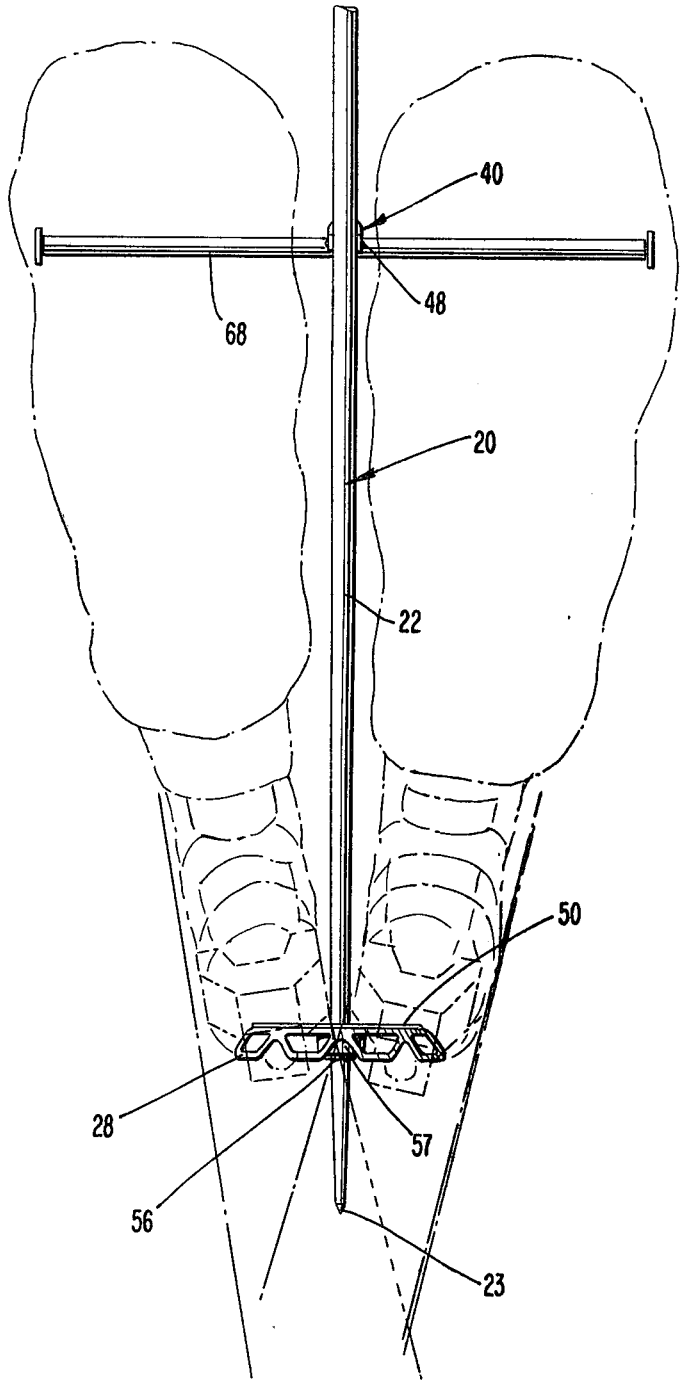
FIG. 2 is a front pictorial view of the improved ski pole according to the present invention provided on a ski chair lift.

With reference now to FIG. 2, the ski pole foot rest according to the present invention is hooked onto the chair of a ski lift with the ski pole extending downwardly between the legs of the skier. The ski chair lift preferably includes a tubular member 68 provided immediately beneath the knees of the skier whereby the first bracket member 40 may selectively engage the tubing of the chair lift. The skier then places his feet which are provided with ski boots and skis onto the annular member 52. The axial distance between the first and second bracket members is preferably predetermined so as to correspond to the distance between the knee and the bottom of the skis of the skier. The axial distance between the first and second bracket members may be chosen so as to provide a comfortable foot rest for the skier.

Figure 3:
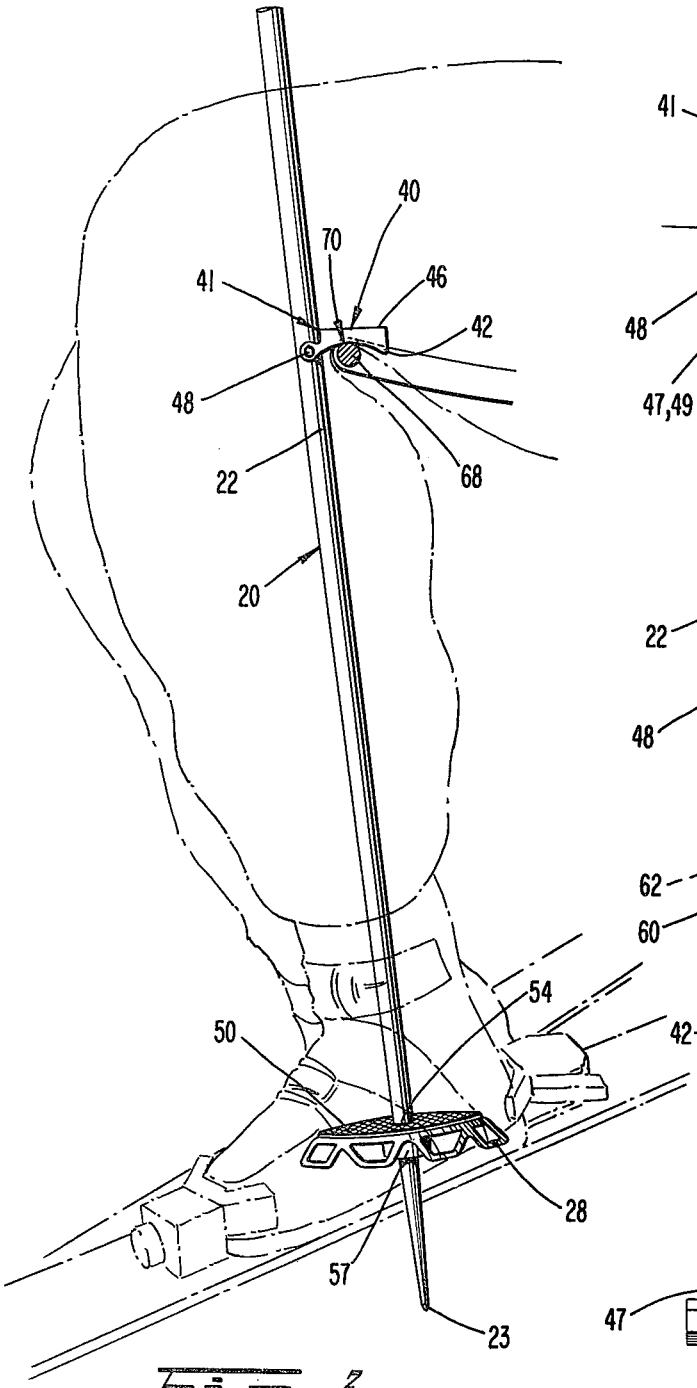
FIG. 3 is a side view of the improved ski pole as depicted in FIG. 2.

Because the bracket 40 extends rearwardly with respect to the ski pole when in use, the weight of the skier's legs on the disk 52 will urge the lowermost portion of the ski pole to be oriented rearwardly as indicated in FIG. 3. The tip of the pole is urged rearwardly since the center of gravity of the pole acts at the point of contact (as illustrated at 70) of the bracket with the front edge portion of the chair. Because the tip of the pole is oriented rearwardly during use, an inadvertent contact of the tip of the pole with the ground during forward movement of the chair lift will cause the tip of the pole to move even further in a rearward direction. Accordingly, the top of the pole will pivot forwardly away from the body of the skier. In this way, potential harm to the skier should he forget to remove the ski pole from the chair before the chair comes into close proximity with the ground is safely avoided.

With reference to FIG. 3, the ski pole 20 is provided immediately adjacent and substantially aligned with the calf of the skier's legs. The skier preferably positions his boots and skis on the disk 52 so that the instep or arch of each foot is located vertically above the annular disk 52.

In operation, the ski pole foot rest is usable as a ski pole during skiing and as a foot rest while the skier is traveling on a ski chair lift. While skiing, the first bracket member, if pivotably attached to the shaft of the ski pole, is pivoted to a position with the bracket substantially aligned with the ski pole. The second bracket member which is preferably an annular disk does not interfere with the operation of the basket of the ski pole during skiing.

To utilize the improved ski pole as a foot rest, the first bracket member is pivoted upwardly to a first position with the first bracket member extending radially outwardly with respect to the ski pole. The bracket member is positioned above a front edge portion of the ski chair lift with the bracket hooking onto the front edge portion of the chair. The ski pole is thereby supported against axial movement downwardly with respect to the chair of the ski lift. The skier positions his feet atop the second bracket member or annular disk with one foot provided on either side of the ski pole. The skier's legs and feet are thereby comfortably supported by the ski pole foot rest while the skier is traveling on the chair lift.

The skier removes his feet from the improved ski pole prior to completion of his travel on the chair lift. The ski pole is lifted off of the front edge portion of the ski chair lift and the bracket is aligned with the pole prior to beginning a session of downhill skiing.

Should the skier fail to remove the improved ski pole from the front edge portion of the chair of the ski lift prior to completion of the travel, the ski pole will not present a danger to the skier. Because the ski pole is hooked on the edge portion of the chair, the ski pole may safely raise up so as not to obstruct movement of the chair of the lift. Furthermore, since the first bracket extends rearwardly of the pole during use, the weight of the skier's legs on the annular disk causes the lower end of the pole to be directed rearwardly. Therefore, should the tip of the pole engage the snow or ground during forward movement of the chair lift, the tip of the ski pole would be urged rearwardly. Such a rearward movement of the tip of the ski pole would urge the uppermost portion of the pole away from the body of the skier.

The principles, preferred embodiments and modes of operation of the present invention have been described in the foregoing specification. The invention which is intended to be protected is not to be limited to the particular forms disclosed, as these are merely illustrative and not restrictive examples. Modifications may be made by those skilled in the art which do not depart from the scope and nature of the present invention.

What is claimed is:

1. An improved ski pole for providing a foot rest during travel of a skier on a ski lift, comprising:

a ski pole including an elongated shaft having a handle at a first end;

first bracket means for extending outwardly of the shaft for releasably fixing the ski pole relative to the ski lift in a first axial direction toward a second end of the shaft;

said first bracket means including at least one recess adapted for engagement with a portion of the ski lift for limiting movement of the shaft toward and away from the ski lift;

the bracket means being pivotably mounted on the shaft at about a mid-section of the shaft, the bracket means being movable between a first position substantially aligned with the shaft and a second position substantially perpendicular to the shaft;

means for preventing the axial movement of the bracket means toward the handle;

means for preventing the pivotal movement of the bracket means beyond said second position toward the handle of the shaft; and second bracket means for extending generally radially outwardly of the shaft for at least a distance sufficient to support a foot of a skier, the second bracket means being selectively fixable relative to the shaft in the first axial direction, the second bracket means being disposed on the shaft a predetermined distance away from the first bracket means toward the second end of the shaft.

2. The improved ski pole of claim 1 wherein the second bracket means extends outwardly of the shaft in at least two radial directions substantially opposite to one another.

3. The improved ski pole of claim 1, wherein the second bracket means comprises a basket arranged adjacent the second end of the shaft.

4. An improved ski pole for providing a foot rest while traveling on a chair lift, comprising:

a ski pole including an elongated shaft having a handle at a first end and a basket at a second end of the shaft;

a bracket member pivotably mounted on the shaft between the handle and the basket at about a mid-section of the elongated shaft, the bracket member movable between a first position substantially aligned with the shaft and a second position substantially perpendicular to the shaft;

means integral with said bracket member for selectively gripping said shaft when the bracket member is in the first position;

means for preventing axial movement of the bracket member towards the handle;

means for preventing the pivotal movement of the bracket member beyond said second position towards the handle of the shaft; and a generally rigid annular member provided between the bracket member and the basket and in close proximity to the basket, the annular member extending generally radially outwardly of the shaft substantially the same distance as a radial extension of the basket and being prevented from axial movement relative to the shaft towards the second end of the shaft beyond a predetermined axial point of the shaft.

5. The improved ski pole of claim 4 wherein the second end of the shaft is tapered so as to decrease in diameter in the direction of the second end of the shaft and wherein the annular member includes a centrally disposed passageway having a diameter which corresponds to the diameter of the shaft at the location of the annular member, the shaft being received by the annular member through the passageway.

6. The improved ski pole of claim 4 wherein the annular member is prevented from axial movement beyond the predetermined axial point of the shaft by a cotter pin passing through the shaft.

7. An improved ski pole for providing a foot rest while traveling on a chair lift comprising:

a ski pole including an elongated shaft having a handle at a first end and a basket at a second end of the shaft;

a bracket member pivotably mounted on the shaft between the handle and the basket, the bracket member being movable between a first position substantially aligned with the shaft and a second position substantially perpendicular to the shaft, the bracket member being substantially channel shaped and having a web portion and first and second side portions, the side portions extending beyond the web portion at one end of the bracket member;

means for preventing the pivotal movement of the bracket member beyond said second position towards the handle of the shaft; and an annular member provided between the bracket member and the basket and in close proximity to the basket, the annular member prevented from axial movement relative to the shaft towards the second end of the shaft beyond a predetermined axial point of the shaft.

8. The improved ski pole of claim 7 wherein the bracket member is pivotably mounted on the shaft at the side portions extending beyond the web portion.

9. The improved ski pole of claim 8 wherein the side portions each include a recessed portion intermediate of either end of the bracket member.

10. An improved ski pole of the type comprising an elongated shaft having an upper end and a lower end, the ski pole being grasped at a handle provided at the upper end, the shaft tapering at the lower end in the direction of the lower end, the improvement comprising:

a bracket member pivotably mounted at about a midsection of the shaft, the bracket member movable between a first position substantially aligned with the shaft and a second position substantially perpendicular to the shaft;

means integral with said bracket member for selectively gripping said shaft when the bracket member is in the first position;

means for preventing axial movement of the bracket member toward the handle;

means for preventing the pivotal movement of the bracket member beyond said second position toward the handle of the shaft; and a generally rigid annular member concentrically provided about the shaft and selectively fixable relative to the shaft in at least an axial direction toward the lower end of the shaft, the annular member extending outwardly of the shaft a radial distance sufficient to support a foot of a skier.

11. An apparatus for converting a ski pole into a foot rest on a chair lift, the ski pole including an elongated shaft having an upper end and a lower end, the lower end including a pointed tip for selectively engaging the ground during skiing, the ski pole including a handle provided at the upper end, the appraratus comprising:

first bracket means for presenting a hook engageable with a portion of the chair lift, the first bracket means being pivotably attachable to said shaft at a first location at about a midsection of the shaft, said first bracket means being movable between a first position generally perpendicular to said shaft and a second position generally aligned with said shaft;

means integral with said first bracket means for selectively gripping said shaft when the first bracket means is in the second position;

means for preventing axial movement of the first bracket means toward the handle;

means for preventing the pivotal movement of the first bracket means beyond said first position toward the handle; and second bracket means for presenting a generally rigid support on said shaft, said support being generally perpendicular to a longitudinal axis of the shaft and having a width sufficient to support a foot of a skier, the second bracket means being attachable to said shaft at a second location below the first bracket means and spaced from the pointed tip.

12. An apparatus for converting a ski pole into a foot rest on a chair lift, the ski pole including an elongated shaft having an upper end and a lower end, the lower end including a pointed tip for selectively engaging the ground during skiing, the ski pole including a basket provided at the lower end, the apparatus comprising:

first bracket means for presenting a hook engageable with a portion of the chair lift, the first bracket means being pivotably attachable to said shaft at a first location spaced from the pointed tip, said first bracket means being movable between a first position generally perpendicular to said shaft and a second position generally aligned with said shaft;

the first bracket means including a rigid member having two side portions and a web portion, the web portion joining the two side portions throughout less than the entire length of the side portions; and second bracket means for presenting a rigid support on said shaft, the second bracket means being attachable to said shaft at a second location below the first bracket means and spaced from the pointed tip, the second bracket means including an annular disk.

* * * * *